US006928659B2

(12) United States Patent
Lee

(10) Patent No.: US 6,928,659 B2
(45) Date of Patent: Aug. 16, 2005

(54) SWEATBAND FOR A CAP

(75) Inventor: Jeong Sik Lee, Seoul (KR)

(73) Assignee: DADA Corp., Seoul (KR)

( * ) Notice: Subject to any disclaimer, the term of this patent is extended or adjusted under 35 U.S.C. 154(b) by 78 days.

(21) Appl. No.: 10/634,803

(22) Filed: Aug. 6, 2003

(65) Prior Publication Data

US 2005/0028246 A1 Feb. 10, 2005

(51) Int. Cl.[7] ..... A42B 1/00
(52) U.S. Cl. ..... 2/175.1
(58) Field of Search ..... 2/195.2, 181, 195.1, 2/195.3, 183, 175.1, 417, 418, 184

(56) References Cited

U.S. PATENT DOCUMENTS

| | | | | | |
|---|---|---|---|---|---|
| 4,406,021 | A | | 9/1983 | Bloom | |
| 5,142,705 | A | | 9/1992 | Edwards | |
| 5,615,415 | A | * | 4/1997 | Beckerman | 2/195.3 |
| 5,715,540 | A | * | 2/1998 | Cho | 2/195.3 |
| 5,915,534 | A | | 6/1999 | May | |
| 5,920,910 | A | | 7/1999 | Calvo | |
| 5,983,398 | A | | 11/1999 | Kronenberger | |
| 6,016,572 | A | * | 1/2000 | Park | 2/195.2 |
| 6,347,410 | B1 | * | 2/2002 | Lee | 2/181 |
| 6,493,880 | B1 | * | 12/2002 | Lo | 2/195.2 |
| 6,502,245 | B1 | * | 1/2003 | McBride | 2/181 |
| 6,571,396 | B1 | * | 6/2003 | Yan | 2/195.1 |
| 6,625,818 | B2 | * | 9/2003 | Putnam | 2/181 |
| 6,817,035 | B2 | * | 11/2004 | Park | 2/181 |
| 2003/0037365 | A1 | * | 2/2003 | Wilson | 2/181 |
| 2003/0097705 | A1 | * | 5/2003 | Han | 2/171 |
| 2003/0131395 | A1 | * | 7/2003 | Putnam | 2/181 |
| 2003/0226192 | A1 | * | 12/2003 | Wang | 2/183 |
| 2003/0226193 | A1 | * | 12/2003 | Wang | 2/195.6 |
| 2004/0199979 | A1 | * | 10/2004 | Ngan | 2/195.1 |

OTHER PUBLICATIONS

Weaving: Conversion of Yarn to Fabric, Lord and Mohamed, Merrow Publishing Co. 1992, pp 157–169.*

* cited by examiner

*Primary Examiner*—Gary L. Welch
(74) *Attorney, Agent, or Firm*—Mayer, Brown, Rowe & Maw LLP

(57) ABSTRACT

A sweatband used for headwear that is woven of 100% polyester wrap-way and weft-way, made to single or two-ply without any polyurethane or additional stitched portion. The resulting sweatband, which preferably has a width between 25–70 mm and provides excellent sweat absorbing capability, exhibits good elasticity through the structure of the textile without imposing undue pressure on the wearer, with the result that the sweatband may be worn comfortably for long periods of time. The yarn used to produce the sweatband is processed by high temperature and piece dyeing methods and has twist per each certain length.

18 Claims, 2 Drawing Sheets

SWEATBAND FOR A CAP

BACKGROUND OF THE INVENTION

1. Field of the Invention

The present invention is related to the field of headwear and, more particularly, to a sweatband that demonstrates efficient sweat-absorbing capability and which has suitable elasticity to remain comfortable for extended use.

2. Description of the Related Art

Caps of the baseball-style type generally include a crown main body, a visor portion that is secured to the forward edge of the crown and extends outwardly therefrom, a headband or sweatband attached to the lower part of the inside of the crown, and a size controller attached to an underside of the rear of the cap. Alternatively, cap sweatbands have been constructed that include an elastic band made of fabric which includes spandex yarn, giving the sweatband size flexibility while eliminating the size controller.

It has been found, however, that caps relying on spandex sweatbands for sizing exert pressure against the wearer's head which can become uncomfortable after the cap is worn for an extended period of time. In addition, the use of spandex yarn in such pre-existing sweatbands increases the cost of the cap.

Accordingly, a need exists for an improved sweatband that is less expensive to manufacture while providing excellent sweat absorbing efficiency and increased wearer comfort through the prevention of undue pressure on the wearer's head so as to remain comfortable over extended time periods.

SUMMARY OF THE INVENTION

In view of the foregoing, one object of the present invention is to provide headwear with a sweatband that does not exert undue pressure on the head when worn.

Another object of the present invention is to provide a cap having excellent sweat-absorbing capability.

A further object of the present invention is to provide a sweatband made without polyurethane that is produced by arranging 100% polyester yarn warp-way and weft-way without the process of making an additional stitching portion for connection to headwear.

Yet another object of the present invention is to provide a sweatband that affords elasticity through the structure of the textile, the yarn from which the sweatband is made being processed by a high temperature and piece dyeing method and having a twist per each certain length.

A still further object of the present invention is to provide a sweatband of sufficient elasticity to provide variable sizing to a cap without the need for a separate size controller.

In accordance with these and other objects, the present invention is directed to a sweatband mainly used for headwear and woven by properly arranging 100% polyester yarn wrap-way and weft-way, without making or needing an additional stitching portion for connection of the sweatband to headwear. Having no polyurethane, the sweatband demonstrates elasticity as a whole due to the structure of the textile, the sweatband being made of yarn processed by a high temperature and piece dyeing method and having a twist per each certain length. The circumferential stretch direction of the sweatband also provides excellent sweat absorption capability. With this construction, a wide range of automatic size adjustment is obtained without imposing undue elastic pressure on the wearer.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
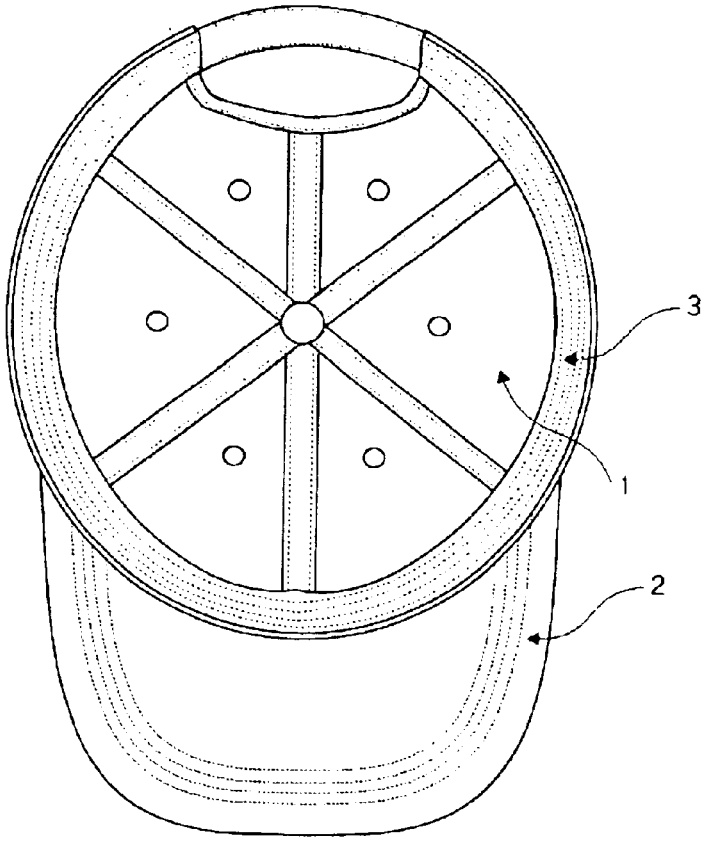
FIG. 1 is a bottom view of a baseball-style cap with a sweatband according to the present invention.

In describing preferred embodiments of the invention illustrated in the drawings, it is to be understood that these embodiments are given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

The present invention is directed to a sweatband suitable for use with headwear of various types, but is described herein in connection with a baseball-style cap as shown in FIG. 1. It is understood that the inventive sweatband may also be used with other types of headwear or even alone.

According to the embodiment illustrated in FIG. 1, the present invention is directed to a baseball-style cap including a crown main body, generally designated by the reference numeral 1, a visor portion, generally designated by the reference numeral 2, and a sweatband, generally designated by the reference numeral 3. The crown part 1 is generally made of more than one piece of fabric, having several panels. The visor portion 2 is secured to the forward edge of the crown main body 1, and the sweatband 3 is secured to the lower peripheral edge of the interior of the crown 1.

Figure 2:
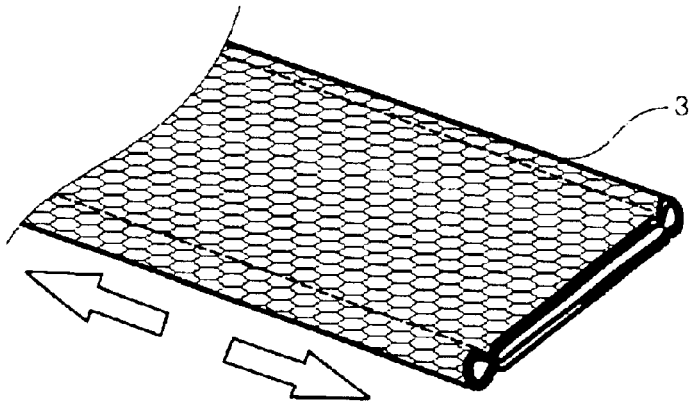
FIG. 2 is a perspective view of the sweatband according to the present invention.

As shown in FIG. 2, the sweatband 3 is woven in a cylinder shape without an additional stitched portion, and may be single ply or two-ply according to the woven shape with the resulting effect that the sweatband is stretchable as a result of the structure of the textile. The stretched direction, shown by the arrows, is along the circumference of the cap which prevents sweat from running down the wearer's forehead when the cap is worn. The sweatband has a width that is preferably within the range of 25 mm to 70 mm and does not include or require an additional stitching portion for connection of the sweatband to headwear. In addition to providing excellent sweat absorbing capability, the sweatband according to the present invention does not exert undue pressure such that the cap remains comfortable when worn for extended time periods. The yarn used to produce the sweatband is processed by a high temperature method and piece dyeing method, and has the feature of twist at regular intervals.

Figure 3:
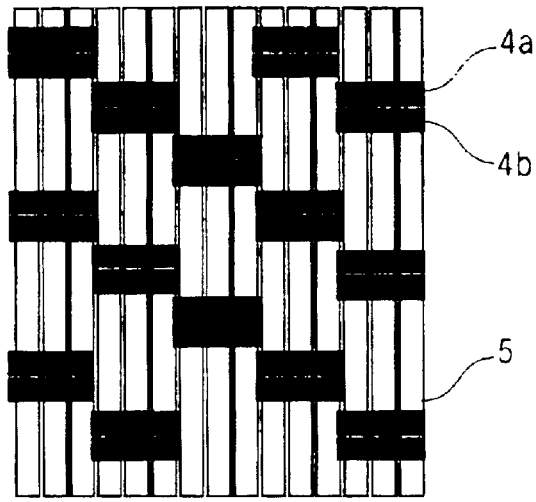
FIG. 3 is an enlarged view of the woven structure of the sweatband according to one embodiment of the present invention.

FIG. 3 is an enlarged view of the woven structure of the inventive sweatband according to a first embodiment. As shown, the sweatband is composed of a plurality of bundles of yarns in weft-way and warp-way, each bundle consisting of 48 yarns and each yarn being 170D, of 100% polyester, which is known as textured yarn, bulk yarn or stretch yarn; the sweatband does not include any polyurethane. A yarn is 1 Denier if the length of it is 9 km and the weight of it is 1 gram. If the weight of the yarn is 170 grams, it is 170D (Denier). The plurality of bundles are woven in warp-way and weft-way, with a twist interval of the weft 4*a*, 4*b* and warp 5 being, according to the preferred embodiment shown, such that the pair of bundles 4*a*, 4*b* in weft-way are placed over 3 bundles and then under the next 6 bundles in warp-way. The resulting sweatband made with this method, providing stretchability through the structure of the textile, may be extended to from 15% to 45% after 10 seconds under 1.8 kg of weight, and exhibits a 0.4% to 3% residual rate within 30 seconds after removal of the weight. The woven type shown in FIG. 3 is woven in a cylinder shape without an additional stitched portion as the sweatband may be stitched directly to the crown portion of desired headwear.

Figure 4:
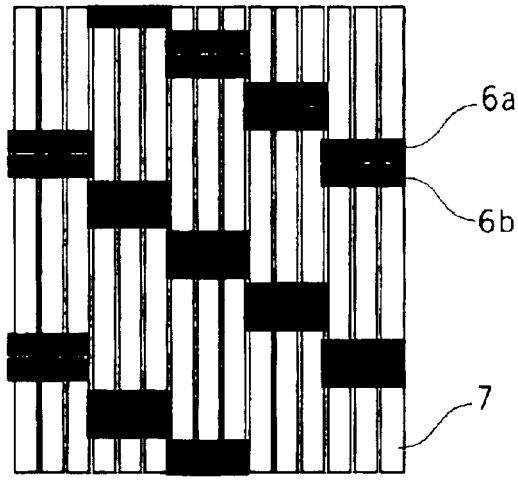
FIG. 4 is an enlarged view of the woven structure of the sweatband according to another embodiment of the present invention.

FIG. 4 is an enlarged view of the woven structure of the invention sweatband according to a second embodiment. As shown, the sweatband is gain composed of a plurality of bundles of yarns in warp-way and weft-way, each bundle consisting of 48 yarns woven in warp-way and weft-way, each yard being 170D, without any polyurethane. The plurality of bundles are woven in warp-way and weft-way such that the pair of bundles 6*a*, 6*b* in weft-way are twisted and placed above 3 bundles and then under the next 9 bundles in warp-way. The sweatband is woven to single ply or two-ply without an additional stitched portion, and exhibits good elasticity as a whole through the structure of the textile.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the headband may be incorporated into hats, caps and visors of other styles, or may be used alone. Therefore, it is not desired to limit the invention to the specific examples disclosed or the exact construction and operation shown and described. Rather, all suitable modifications and equivalents may be resorted to, falling within the scope of the invention.

What is claimed is:

1. A stretchable sweatband for headwear, said sweatband woven with a plurality of bundles of yarns in weft-way and warp-way, each bundle consisting of 48 yarns containing no polyurethane, wherein a pair of bundles in weft-way is repeatedly and continuously twisted in an interval such that the pair of bundles are placed over 3 bundles and then under the next 6 bundles in warp-way.

2. The sweatband as set forth in claim 1, wherein said yarns are 100% polyester.

3. The sweatband as set forth in claim 2, wherein said sweatband is woven in a cylinder shape without any additional stitching portion for connecting of said sweatband to headwear.

4. The sweatband as set forth in claim 1, wherein the sweatband is single ply.

5. The sweatband as set forth in claim 1, wherein the sweatband is two-ply.

6. The sweatband as set forth in claim 1, wherein the sweatband has a width of about 25 mm to 70 mm.

7. The sweatband as set forth in claim 1, wherein each yarn is 170D.

8. A stretchable sweatband for headwear, said sweatband woven with a plurality of bundles of yarns in weft-way and warp-way, each bundle consisting of 48 polyester yarns containing no polyurethane, wherein a pair of bundles in weft-way is repeatedly and continuously twisted in an interval such that the pair of bundles are placed over 3 bundles and then under the next 9 bundles in warp-way.

9. The sweatband as set forth in claim 8, wherein said yarn is processed by high temperature and piece dying methods and has twist at regular intervals.

10. The sweatband as set forth in claim 8, wherein the sweatband may be extended from 15% to 45% after 10 seconds under 1.8 kg of weight, with a residual rate of 0.4% to 3% within 30 seconds of weight removal.

11. The sweatband as set forth in claim 10, wherein said sweatband is woven in a cylinder shape without any additional stitching portion for connecting of said sweatband to headwear.

12. The sweatband as set forth in claim 10, wherein the sweatband is single ply.

13. The sweatband as set forth in claim 10, wherein the sweatband is two-ply.

14. The sweatband as set forth in claim 8, wherein the sweatband has a width of about 25 mm to 70 mm.

15. The sweatband as set forth in claim 8, wherein each yarn is 170D.

16. Headwear comprising:

a crown main body;

a visor portion secured to a peripheral edge of said crown main body and extending outwardly therefrom; and a sweatband woven in a cylinder shape and attached along said lower peripheral edge of said crown main body, said sweatband woven with a plurality of bundles of yarns in weft-way and warp-way, each bundle consisting of 48 100% polyester yarns containing no polyurethane, wherein a pair of bundles in weft-way is repeatedly and continuously twisted in an interval such that the pair of bundles are placed over 3 bundles and then under the next 9 bundles in warp-way.

17. The headwear as set forth in claim 16, wherein the sweatband has a width of about 25 mm to 70 mm, and may be longitudinally extended from 15% to 45% after 10 seconds under 1.8 kg of weight, with a residual rate of 0.4% to 3% within 30 seconds of weight removal.

18. The headwear as set forth in claim 16, wherein each yarn is 170D with no polyurethane.

* * * * *